US007847694B2

(12) United States Patent
Lee et al.

(10) Patent No.: US 7,847,694 B2
(45) Date of Patent: Dec. 7, 2010

(54) ELECTRONIC TAG INCLUDING PRIVACY LEVEL INFORMATION AND PRIVACY PROTECTION APPARATUS AND METHOD USING RFID TAG

(75) Inventors: Byung Gil Lee, Daejeon (KR); Doo Ho Choi, Chungcheongnam-do (KR); Ho Won Kim, Daejeon (KR); Kyo Il Chung, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 231 days.

(21) Appl. No.: 11/484,294

(22) Filed: Jul. 10, 2006

(65) Prior Publication Data

US 2007/0040654 A1 Feb. 22, 2007

(30) Foreign Application Priority Data

Aug. 19, 2005 (KR) ..... 10-2005-0076452
Nov. 4, 2005 (KR) ..... 10-2005-0105482

(51) Int. Cl.
*G08B 13/14* (2006.01)

(52) U.S. Cl. ..... 340/572.1; 340/10.1

(58) Field of Classification Search ..... 340/572.1, 340/10.1

See application file for complete search history.

(56) References Cited

U.S. PATENT DOCUMENTS 7,312,707 B1 * 12/2007 Bishop et al. ..... 340/572.1
2002/0005774 A1 * 1/2002 Rudolph et al. ..... 340/5.61

(Continued)

FOREIGN PATENT DOCUMENTS

JP 2003-044607 2/2003

(Continued)

OTHER PUBLICATIONS

Cambridge Dictionary Online (http://dictionary.cambridge.org/define.asp?key=55331&dict=CALD), Oct. 3, 2008.*

(Continued)

*Primary Examiner*—George A Bugg
*Assistant Examiner*—Kerri McNally
(74) *Attorney, Agent, or Firm*—Blakely, Sokoloff, Taylor & Zafman LLP

(57) ABSTRACT

An electronic tag including privacy level information, and a privacy protection apparatus and method using the electronic tag are provided. The privacy protection apparatus using an electronic tag includes: an information storing unit storing recognition information of an electronic tag and privacy information on the electronic tags; an information request/response processing unit receiving the recognition information of electronic tags and information on a user that requests information on the electronic tags through a predetermined communication network; a privacy policy managing unit determining whether the privacy information on the electronic tags corresponding to the recognition information of electronic tags is stored in the information storing unit; and an information disclosure determination processing unit, if it is determined that the privacy information on the electronic tags is stored in the information storing unit, comparing the information on the user and a predetermined standard for publishing the privacy information, determining how much of the privacy information on the electronic tags is provided to the user, and providing the determined privacy information to the user.

4 Claims, 5 Drawing Sheets

U.S. PATENT DOCUMENTS

| | | | | |
|---|---|---|---|---|
| 2005/0007236 | A1* | 1/2005 | Lane et al. | 340/5.86 |
| 2005/0128083 | A1* | 6/2005 | Puzio et al. | 340/572.1 |
| 2005/0278222 | A1* | 12/2005 | Nortrup | 705/17 |
| 2006/0040704 | A1* | 2/2006 | Bayley et al. | 455/556.1 |
| 2006/0077034 | A1* | 4/2006 | Hillier | 340/5.61 |
| 2006/0087407 | A1* | 4/2006 | Stewart et al. | 340/10.52 |

FOREIGN PATENT DOCUMENTS

| | | | |
|---|---|---|---|
| JP | 2004-192645 | | 7/2004 |
| JP | 2004-310557 | | 11/2004 |
| JP | 2004-318478 | | 11/2004 |
| JP | 2005-92585 | | 4/2005 |
| KR | 1020030089045 | A | 11/2003 |
| WO | WO-2005-031579 | | 4/2005 |
| WO | WO-2006-088306 | | 8/2006 |
| WO | WO-2007-102709 | | 9/2007 |

OTHER PUBLICATIONS

Ari Juels et al., "Squealing Euros: Privacy Protectionn in RFID-Enabled Banknotes", R.N. Wright (Ed.): FC 2003, LNCS 2742, pp. 103-121, 2003. Springer-Verlag Berlin Heidelberg 2003.

* cited by examiner

ELECTRONIC TAG INCLUDING PRIVACY LEVEL INFORMATION AND PRIVACY PROTECTION APPARATUS AND METHOD USING RFID TAG

CROSS-REFERENCE TO RELATED PATENT APPLICATIONS

This application claims the benefit of Korean Patent Application Nos. 10-2005-0076452 and 10-2005-0105482, filed on Aug. 19 and Nov. 4, 2005, respectively, in the Korean Intellectual Property Office, the disclosures of which are incorporated herein in their entirety by reference.

BACKGROUND OF THE INVENTION

1. Field of the Invention

The present invention relates to an electronic tag, and more particularly, to an electronic tag including privacy level information for protecting privacy, and a privacy protection apparatus and method using the electronic tag.

When users own products to which radio frequency identification (RFID) tags are attached through manufacturing, logistics, and distribution, the present inventions solves a personal privacy problem due to an illegal information exposure relating to RFID tags and provides users with a safe RFID service.

2. Description of the Related Art

RFID is used to manage information connected to networks in real-time by sensing all surrounding information on objects or locations to which RFID tags are attached based on recognition information obtained from the RFID tags. RFID that provides recognition information and additionally senses information is expected to be a wireless sensor network (WSN).

More specifically, if RFID is introduced to a distribution and logistics system, manufacturers can automatically instruct workers which vehicle is used to carry products using information stored in RFID tags attached to the products. If the products to which the RFID tags are attached arrive, a management system recognizes the products, automatically examines the number and list of the products, and supplies the products to stores. By doing so, stores can determine the amount of stock required by consumers and order products accordingly. The products owned by the consumers provide support, inform consumers of their replacements in advance, and provide a user made service. Also, RFID determines authenticity of products and allows users to confirm distribution processes, thereby increasing service quality.

FIG. 1 is a diagram illustrating a structure of a conventional radio frequency identification (RFID) service network. Referring to FIG. 1, a RFID reader 120 reads information on a product to which a passive or active RFID tag 100 is attached through a predetermined band of frequency signal network 110. Since a real amount of memory of the RFID tag 100 is limited, the RFID reader 120 reads a very small amount of information. To obtain more information on the product, the RFID tag recognition information read by the RFID reader 120 is transferred to an information server 140 through a component/service such as middleware 130.

Since the RFID reader 120 repeatedly reads the RFID tag 100, the middleware 130 filters redundant content and changes the filtered content into a standard format of an event.

If there is information corresponding to the RFID tag recognition information, the information server 140 provides the corresponding information to an application program 150.

Personal privacy is not considered in the conventional RFID service network. For example, when a user purchases a product and carries the product in a user's bag since the user is reluctant to reveal the product to other persons, a RFID reader attached to a cellular phone of another person passing by the user reads a RFID tag attached to the product in the user's bag and reads information on the product in the RFID service network illustrated in FIG. 1.

However, security is not protected in an environment where information is automated and easily obtained. A user's private information such as location and purchase data information can be exposed due to RFID tags attached to products. For example, private personal information such as stores selling the products, information on other products purchased by users who have purchased the products, locations where the products are used, etc. can be easily exposed. RFID tags can be easily identified and automatically respond to all readers while users are not informed. An RFID/WSN environment where information is automated and easily obtained is susceptible to a serious breach of security.

However, it is difficult to use conventional information protection methods due to limited memory embedded in RFID tags. It is also more difficult to respond to attacks against a wide range of objects rather than attacks against an individual.

Attack objects in the WSN environment comprise information on objects or individuals other than information stored in computers or communication information. Attack ranges are not limited to personal computers but every personal space of an individual. Since ranges of damage caused by attacks can be easily extended, a method of solving an invasion of individual privacy is necessarily required.

To address these problems, guidelines for personal privacy are provided. A technical method does not allow RFID tags attached to products purchased by consumers to access data stored in the RFID tags using a KILL command to prevent the RFID tags from being reused. However, this method is contrary to an aim of RFID tags to provide users with convenience via industrial applications of the RFID tags.

Therefore, there is no fundamental solution for protecting personal privacy in an industrial field using RFID tags.

SUMMARY OF THE INVENTION

The present invention provides an electronic tag including privacy level information for securing personal privacy in order to prevent information corresponding to the personal privacy from being exposed through the electronic tag, and a privacy protection apparatus and method using the electronic tag.

According to an aspect of the present invention, there is provided an electronic tag, which transmits information stored therein through a predetermined frequency band of a signal, comprising privacy level information, the electronic tag comprising: a tag ID region containing recognition information distinguishing the electronic tag from other electronic tags; and a privacy level region containing level information indicating an authorization used to access privacy information, relating to the electronic tag, stored in a connectable location corresponding to the recognition information contained in the ID region through a predetermined communication network.

According to another aspect of the present invention, there is provided a privacy protection apparatus using an electronic tag, comprising: an information storing unit storing recognition information of an electronic tag and privacy information on the electronic tags; an information request/response processing unit receiving the recognition information of electronic tags and information on a user that requests information on the electronic tags through a predetermined communication network; a privacy policy managing unit determining whether the privacy information on the electronic tags corresponding to the recognition information of electronic tags is stored in the information storing unit; and an information disclosure determination processing unit, if it is determined that the privacy information on the electronic tags is stored in the information storing unit, comparing the information on the user and a predetermined standard for publishing the privacy information, determining how much of the privacy information on the electronic tags is provided to the user, and providing the determined privacy information to the user.

According to another aspect of the present invention, there is provided a privacy protection method using an electronic tag, comprising: storing recognition information of electronic tags and privacy information on the electronic tags; receiving the recognition information of electronic tags and information on a user that requests information on the electronic tags through a predetermined communication network; determining whether the privacy information on the electronic tags corresponding to the recognition information of the electronic tags is stored; comparing the information on the user and a predetermined standard for publishing the privacy information if it is determined that the privacy information on the electronic tags is stored; and determining how much of the privacy information on the electronic tags is provided to the user, and providing the determined privacy information to the user.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 2:
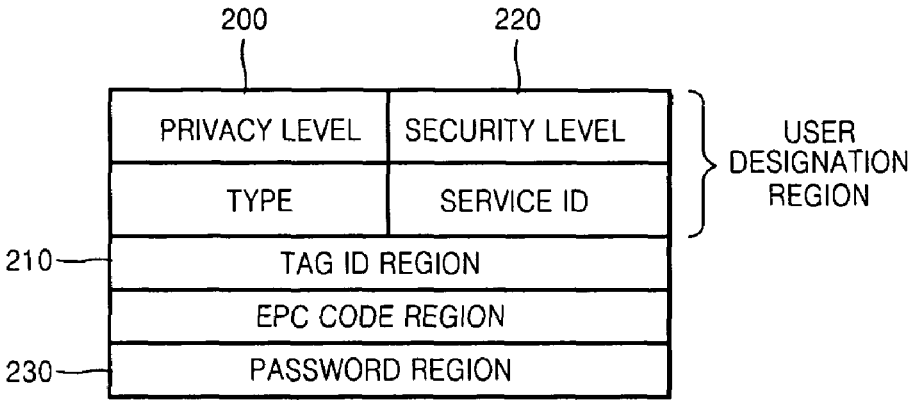
FIG. 2 is a diagram illustrating a structure of a memory of a RFID tag including privacy level information according to an embodiment of the present invention.

FIG. 2 is a diagram illustrating a structure of a memory of a RFID tag including privacy level information according to an embodiment of the present invention. The structure of the memory is not limited thereto. Referring to FIG. 2, a region designated by a user includes a privacy level information region 200 according to the current embodiment of the present invention. Information read by a RFID reader includes a RFID tag ID stored in a RFID tag ID region 210. The RFID tag ID is an intrinsic value of the RFID tag.

The RFID tag receives a specific frequency band of a signal from the RFID reader and transmits stored information using a predetermined frequency band of a signal. A password is required to access the RFID tag and password information is stored in a password region 230 of a memory of the RFID tag where the password is stored.

The security level region 220 according to the current embodiment of the present invention can be used for the privacy level information or both the privacy level region 200 and the security level region 220 can be used for the primary level.

The privacy level information region 200 according to the current embodiment of the present invention is securely stored in a region protected by the password stored in the password region 230.

Figure 3:
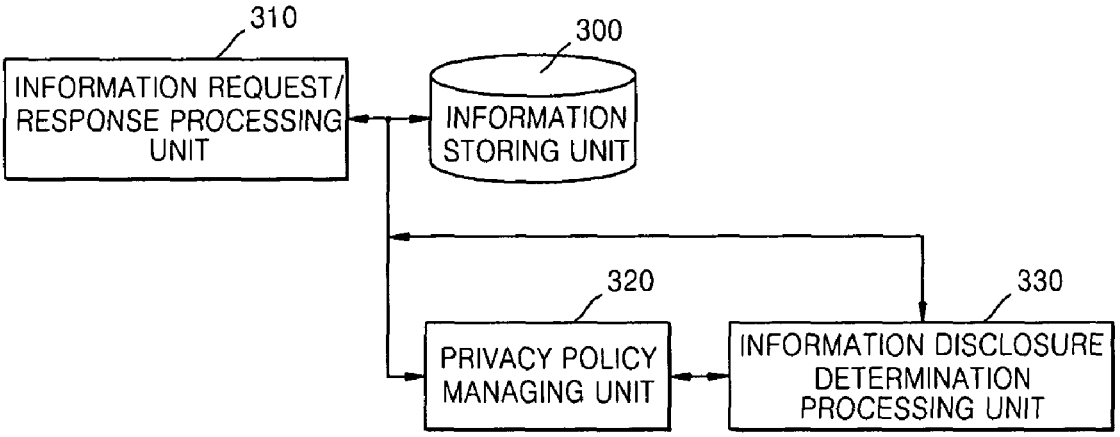
FIG. 3 is a block diagram illustrating a privacy protection apparatus using a RFID tag according to an embodiment of the present invention.

FIG. 3 is a block diagram illustrating a privacy protection apparatus using a RFID tag according to an embodiment of the present invention. Referring to FIG. 3, the privacy protection apparatus comprises an information storing unit 300 that stores recognition information of RFID tags and privacy information on the RFID tags, an information request/response processing unit 310 that receives the recognition information of the RFID tags and information on a user that requests information on the RFID tags through a predetermined communication network, a privacy policy managing unit 320 that determines whether the privacy information on the RFID tags corresponding to the recognition information of the RFID tags is stored in the information storing unit 300, and an information disclosure determination processing unit 330 that, if it is determined that the privacy information on the RFID tags is stored in the information storing unit 300, compares the information on the user and a predetermined standard for publishing the privacy information, determines how much the privacy information on the RFID tags is provided to the user, and provides the determined privacy information to the user.

Figure 4:
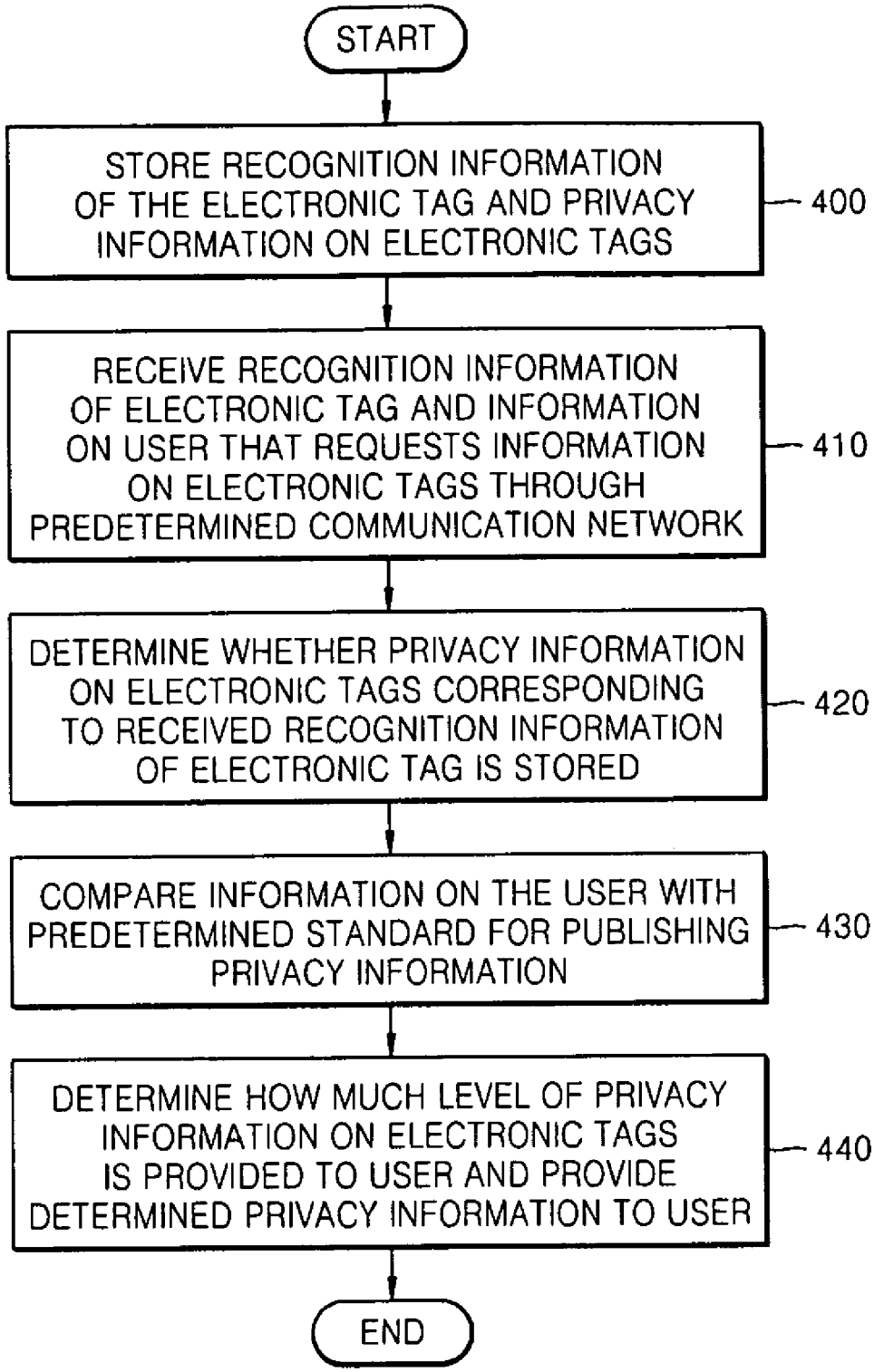
FIG. 4 is a flowchart illustrating a privacy protection method using a RFID tag according to an embodiment of the present invention.

FIG. 4 is a flowchart illustrating a privacy protection method using a RFID tag according to an embodiment of the present invention. Referring to FIG. 4, information recognized by RFID tags and privacy information on the RFID tags are stored (Operation 400). The recognition information of RFID tags and information on a user that requests information on the RFID tags are received through a predetermined communication network (Operation 410). It is determined whether the privacy information on the RFID tags corresponding to the recognition information of the RFID tags is stored (Operation 420), and if it is determined that the privacy information on the RFID tags is stored, the information on the user is compared with a predetermined standard for publishing the privacy information (Operation 430), it is determined how much the privacy information on the RFID tags is provided to the user, and the determined privacy information is provided to the user (Operation 440).

When a product is manufactured, most of the information on the product is information relating to the manufacturing of the product. The information on the product can include material composition information of the product, the place of origin, the place where the product was manufactured, a factory, manufacturing processes, persons in charge of the manufacturing processes, owner information, a manufacturing date, after-sales service, etc. When a RFID tag is attached to the product, the RFID tag ID 210 illustrated in FIG. 2 is provided to the RFID tag, and the privacy level 200 is provided to the RFID tag ID 210.

The RFID tag and the information on the product are stored in the information storing unit 300.

Public information such as a product code, a product name, a manufacturing date, etc. can be designated as the privacy level 200. The privacy level 200 can be separately designated as per specific information. For example, private information such as a cost price is not disclosed in every case.

When the product is distributed, distribution channels or particulars can be read from the RFID tag attached to the product so that information corresponding to the RFID tag ID of the RFID tag can be stored in the information storing unit 300. The privacy level 200 can be separately designated as per specific information.

If the privacy level 200 is not separately designated, the privacy level 200 is designated as a basic level. In this case, specific information has a different privacy level. For example, when a user that purchased the product is reluctant to reveal the product to other persons, information on a name of the product is designated as having a high privacy level, thereby preventing the product name from being revealed to other persons.

The user can obtain information on the product during the distribution process from the information request/response processing unit 310. The user obtains information on a privacy level of the product from the RFID tag attached to the product using the RFID reader attached to a cellular phone carried by the user. A screen of the cellular phone can be a service interface screen.

When the product has a very high privacy level, the user cannot obtain the information on the product even using the privacy protection apparatus illustrated in FIG. 3. The user abandons obtaining the information on the product, which prevents a bandwidth of a wireless communication network from being used.

Unlimited information such as the name of the product or a manufacturing company can be displayed on the screen of the cellular phone. Alternatively, it is displayed on the screen of the cellular phone that other information limited by the privacy level, so that the user can determine whether to obtain the information on the product using the privacy protection apparatus illustrated in FIG. 3.

If the user connects the information request/response processing unit 310 through the wireless communication network according to the privacy level displayed on the screen of the cellular phone, and the cellular phone transmits the RFID tag ID of the RFID tag and the information on the user. The privacy level of the product can be also transmitted when required.

The information on the user includes a user ID, a password, authentication certificate information necessary for a user authentication, etc. Personal information such as an identification number of the user can be also transmitted when required. Information recorded in a smart card embedded in the cellular phone can be automatically transmitted so that the information on the user recorded in the smart card and the RFID tag ID can be also transmitted.

The privacy policy managing unit 320 receives the RFID tag ID and determines whether information corresponding to the RFID tag ID is stored in the information storing unit 300. If it is determined that the information corresponding to the RFID tag ID is stored in the information storing unit 300, the information disclosure determination processing unit 330 determines whether particular information on the product can be provided to the user based on the information on the user transmitted with the RFID tag ID. A privacy level of the user is determined based on the information on the user and is compared with a privacy level of each piece of the specific information on the product, thereby determining whether to provide the specific information on the product to the user. As a result of the determination, some specific information can be provided to the user, and the other specific information cannot be provided to the user. No specific information can be provided to the user.

By doing so, the user can see basic information on the product according to the predetermined privacy level of the product, and additional information on the product according to the privacy level of the user via an additional selection, so that privacy of the product can be secured during the distribution process.

When the user purchases the product in an end store, information on a credit card or a points card used to pay for the product or issue a bill, or information on the user can be read by a point-of-sale (POS) system and be stored in the information storing unit 300 through the wireless communication network. The information on the user can be based on information on the credit card owned by the user, or information on the user previously stored in the end store.

The Information on the user that purchases the product at an offline store or an online store can be stored in the information storing unit 300.

The privacy level of the product may be adjusted by the user who becomes the owner. To this end, the owner connects the information request/response processing unit 310 over the Internet or the wireless communication network using a computer or the cellular phone and changes the privacy level.

It is determined whether the owner is authorized using the information on the credit card or the points card used by the owner, or the personal information such as the identification number previously stored in the end store, or the authentication certificate. Since the personal information on the owner of the product is stored in the information storing unit 300, the personal information is compared with information input by the owner through the wireless communication network to determine whether the owner is authorized.

In order that the user who becomes the owner of the product enjoys an advantage according to the present invention, the user does not connect to the privacy protection apparatus illustrated in FIG. 3 but can previously register connection information such as an email address or a cellular phone number besides the personal information necessary for the authentication of the user in the store. If the user purchases the product, the store automatically transmits the connection information to the privacy protection apparatus illustrated in FIG. 3. Thereafter, the privacy protection apparatus illustrated in FIG. 3 can guide the owner to modify content relating to privacy because of a change of the owner of the product through the email address or the cellular phone number. The owner can connect to the privacy protection apparatus illustrated in FIG. 3. In this case, it is determined whether the owner is authorized as described above.

The owner can change the privacy level of the specific information on the privacy on the product. Sensitivity of privacy depends on personal priority, so that the owner can designate the privacy level of his own belongings.

When the owner designates the privacy level, whether to disclose the specific information on the product is determined according to who requests the specific information. For example, the specific information is not disclosed when it is requested by an unrelated person. When a person in charge of after-sales service of the product requests the specific information, it is not disclosed.

The privacy level according to the specific information on the product can be designated using a variety of methods. However, the present invention is not limited thereto.

The privacy protection apparatus illustrated in FIG. 3 provides a screen to the owner to input the privacy level. The owner designates the privacy level according to the specific information and stores the designated privacy level. The information disclosure determination processing unit 330 determines whether to disclose the specific information on the product based on the designated privacy level.

The user cannot access information that is not allowed to persons other then a manufacturer.

The current embodiment of the present invention is applied to the purchase of a product but can be applied to the supply of a variety of services.

For example, a medical service to which a RFID tag is attached is provided to a user according to an embodiment of the present invention. When the user goes to hospital again, information on the user can be obtained by reading the RFID tag attached to the medical service previously provided to the user. A high privacy level can be designated to the RFID tag. Information corresponding to an ID of the RFID tag is medical information on the patient and is stored in the information storing unit 330.

The user designates privacy levels of specific information of the medical information so as to prevent other persons from accessing the medical information. For example, information such as a user's age, a user's blood type, and contact numbers of user's family members necessary for an emergency medical service can have a relatively low privacy level.

Also, a privacy level can be designated for a financial service provided to the user according to the current embodiment of the present invention. The financial service to which a RFID tag is attached is provided to the user and is stored in the information storing unit 300 so that the user can designate the privacy level for specific information of the financial service. It is obvious that the user can designate the privacy level of the specific information or use the privacy level previously designated for the specific information.

A hospital providing the medical service or a bank providing the financial service inputs the medical or financial information on the user in the information storing unit 300. Also, the hospital or the bank inputs basic privacy levels of the specific information of the medical or financial information before the user designates the privacy levels.

When the owner carries his purchased product with him, a RFID reader carried by other persons can read information on the product on purpose or accidentally. When the RFID reader is attached to a cellular phone, an approximate location of the owner can be detected using a location tracking service of the cellular phone. Therefore, the location of the user can be detected using the privacy protection method of the current embodiment of the present invention, and information on the location of the user is also stored in the information storing unit 300.

As described above, the more RFID tags are used, the more the privacy of the product owner can be exposed. To protect the privacy of the product owner, after an owner of a product to which a RFID tag is attached is determined, the information disclosure determination processing unit 330 preferably informs an authorized owner of a request for disclosure of information on the RFID tag via a predetermined communication network regardless of the disclosure of the information. The information disclosure determination processing unit 330 can disclose the information with an owner's permission.

According to another embodiment of the present invention, information read by a digital camera embedded in the cellular phone from a barcode attached to a label of a product is replaced with the RFID tag ID.

As per a request for information on the product, if an owner of the product is previously registered, only information allowed by the owner can be disclosed so that privacy of the owner can be protected.

Figure 1:
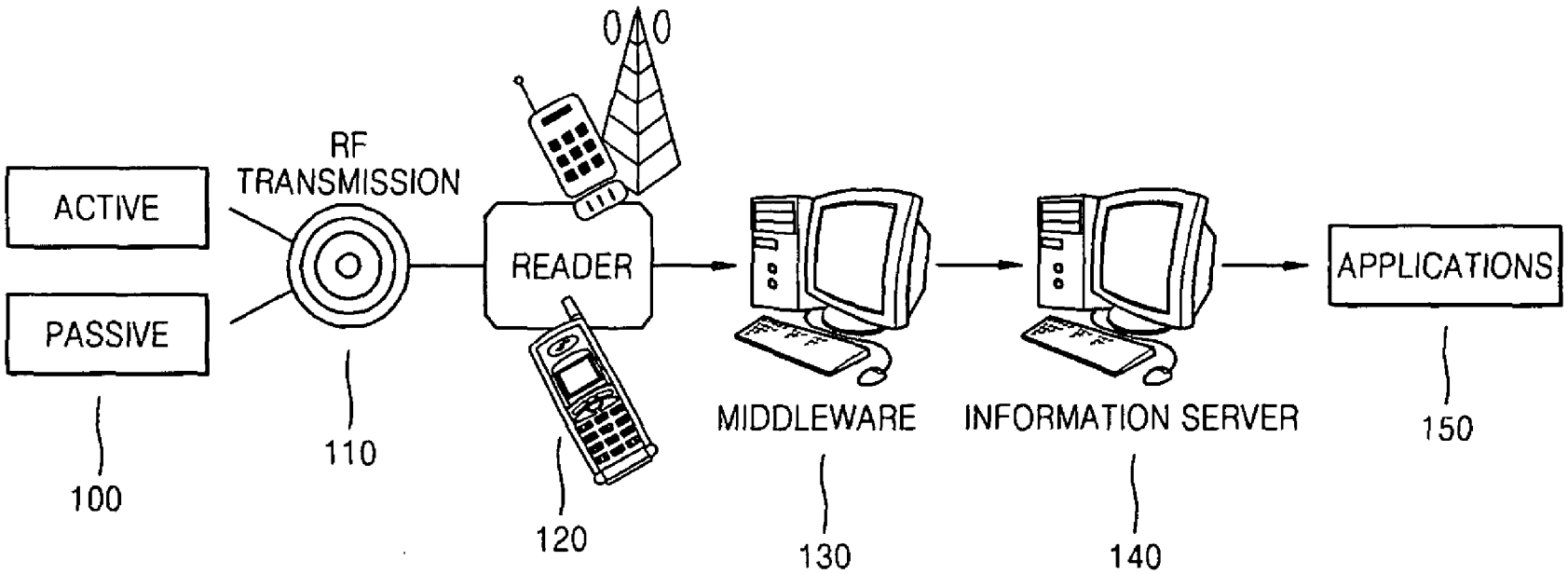
FIG. 1 is a diagram illustrating a structure of a conventional radio frequency identification (RFID) service network.
Figure 5:
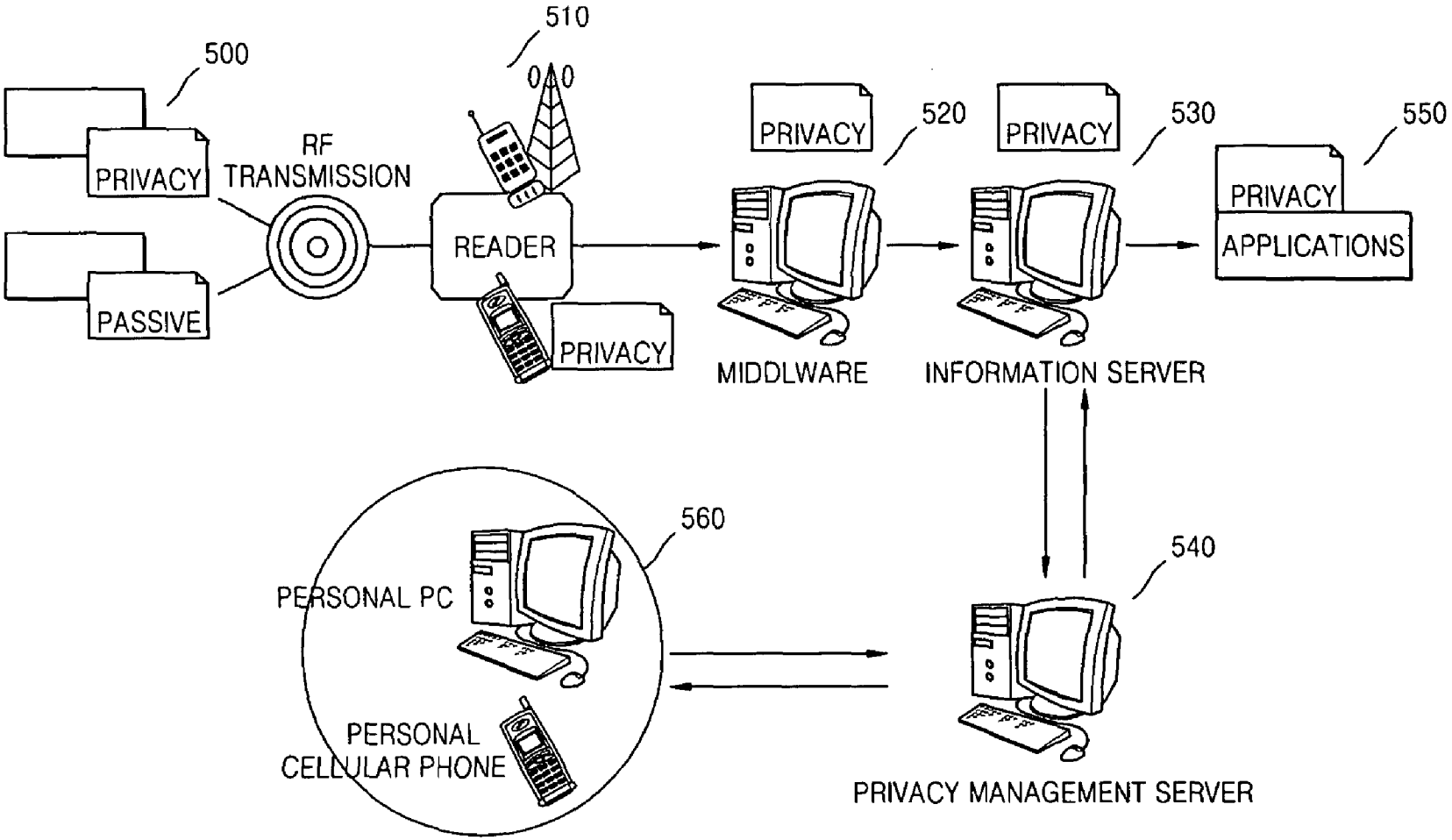
FIG. 5 illustrates a structure of a RFID service network using a privacy protection apparatus according to an embodiment of the present invention.

FIG. 5 illustrates a structure of a RFID service network using a privacy protection apparatus according to an embodiment of the present invention. Referring to FIG. 5, reference numerals 500, 510, 520, 530, and 550 represent the same elements as reference numerals 100, 120, 130, 140, and 150 of FIG. 1, respectively. However, an information server 530 receives a request for a product relating to a RFID tag 500 from a reader 510 reading information on the RFID tag 500 through a middleware 520, inquires of a privacy management server 540, and receives information on the product. The information server 530 transfers the information/result to an application program 550 as when required.

The operation of the privacy management server 540 using the privacy protection apparatus illustrated in FIG. 3 will now be described. The operation of the information server 530 using the privacy protection apparatus illustrated in FIG. 3 will be described later.

An end user reads information from the RFID tag 500 using the reader 510 and requests access to the information server 530.

The RFID tag can include recognition information of the RFID tag 500 and additional information. However, since the RFID tag 500 has limited memory, an ID of the RFID tag 500 or minimum information on the RFID tag 500 is included in the RFID tag 500 and the ID of the RFID tag 500 is analysed to obtain an additional information server address, so that more information can be obtained through an additional information server. This method is similar to a method of accessing the Internet. That is, although an address such as www.etri.re.kr is used instead of an IP address, the address is internally converted into the IP address 129.254.122.11 through a domain name service (DNS).

A RFID recognition information confirmation server, one of a number of additional information servers for utilizing the ID of the RFID tag 500, stores a recognition code of each of RFID tags and universal resource identifier (URI) information of an RFID application server providing the additional information.

If the recognition code is transferred to the RFID recognition information confirmation server through a network such as the Internet and the RFID application server is inquired, an URI address of the RFID application server is returned. The method is performed through the DNS and is well known.

The URI address of the RFID application server is transferred in the form of http://www.etri.re.kr/uri.html. The RFID application server provides resources requested by a user through a web service or web.

A contact address of the information server 530 can be determined through the above process.

A privacy management module (not shown) of the information server 530 receives information from a user and transfers the information to the privacy management server 540 to inquire about a privacy level to be applied to a service.

A privacy management server authenticates the user using an authentication protocol, reads (e.g., user information level 1, kinds of products level 3, product names level 2, manufacturing dates of products level 4, product codes level 2, etc.) data relating to the privacy level of the user suitable for an application service from a privacy client, and provides the data to the privacy management module of the information server 530.

The information server 530 stores the received privacy information in a field of the information server 530 as additional information. Thereafter, the information server 530 can directly process a request for information without requesting the privacy management server 540. In this case, the information server 530 is operated using the privacy protection apparatus illustrated in FIG. 3 without requesting the privacy management server 540.

An owner of a product to which a RFID tag is attached changes data regarding a privacy access level of a user through a computer or a cellular phone 560. This applies to a case where the user re-designates his own privacy level. In this regard, the privacy management server 540 must inform the information server 530 that the privacy level of the owner stored in the information server 530 is invalid.

Figure 6:
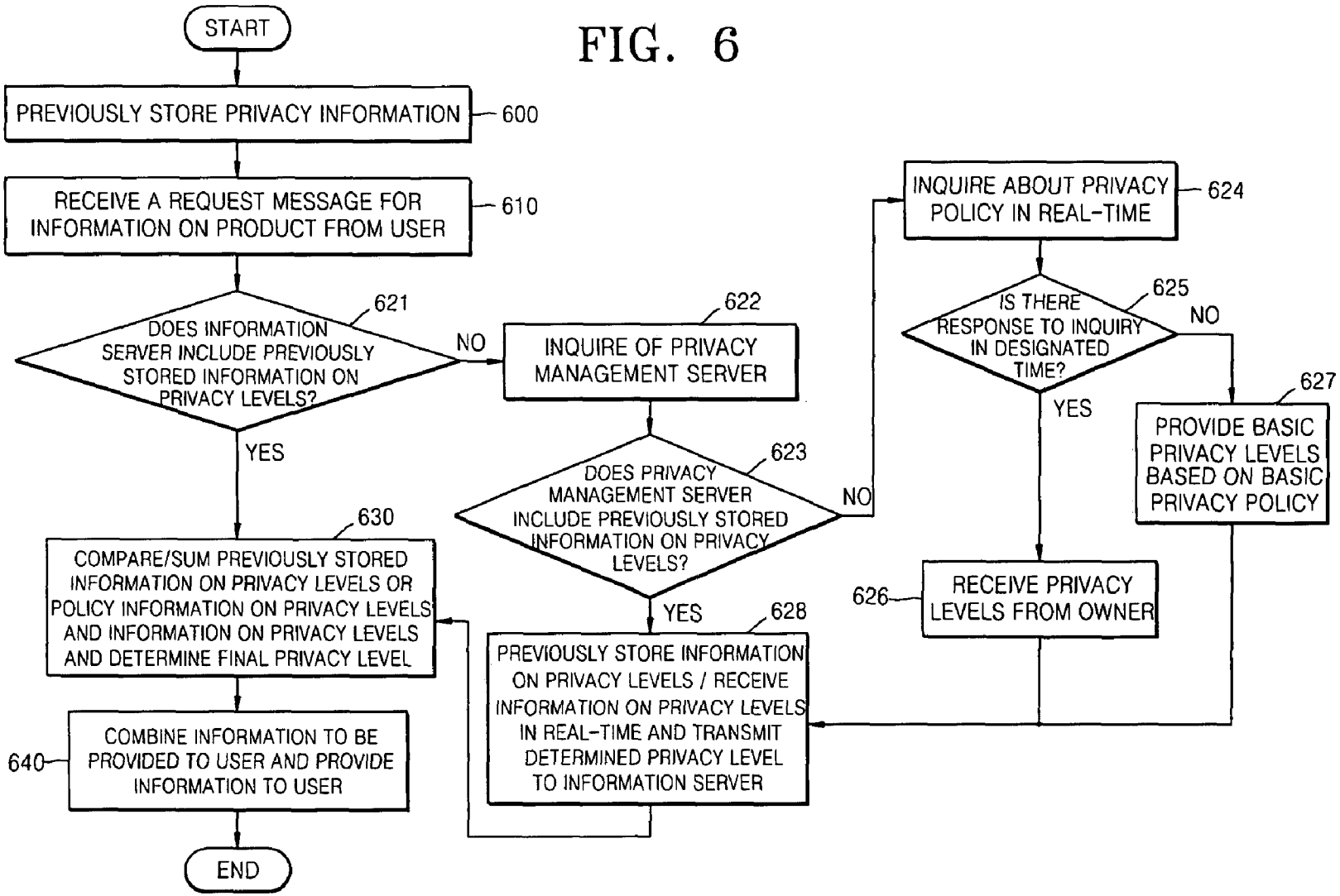
FIG. 6 is a flowchart illustrating a privacy protection method using the RFID service network illustrated in FIG. 5 according to an embodiment of the present invention.

FIG. 6 is a flowchart illustrating a privacy protection method using the RFID service network illustrated in FIG. 5 according to an embodiment of the present invention. The privacy protection apparatus illustrated in FIG. 3 is wholly or partly included in the information server 530 and the privacy management server 540.

Referring to FIG. 6, privacy information on products or services is previously stored by products or by services (Operation 600). The privacy information on the products is stored when manufactured or when product ownership is changed. A manufacturer stores a privacy level on a product in a RFID tag attached to the product. If occasion demands, an ID of the RFID tag, information on the product, and privacy levels of specific information can be stored in the information server 530 or the privacy management server 540.

When the product ownership is changed, a new owner connects to the privacy management server 540 through the Internet or a wireless communication network using a computer or a cellular phone and determines a privacy level of his/her own product.

When the information server 530 receives a request message for information on the product including information on privacy levels stored in the RFID tag and the ID of the RFID tag from a user (Operation 610), the information server 530 determines whether the information on privacy levels is previously stored (Operation 621).

If it is determined that the information on privacy levels is not previously stored, the ID of the RFID tag is transferred to the privacy management server 540 to request the information on privacy levels on the product corresponding to the RFID tag (Operation 622).

The privacy management server 540 determines whether the information on privacy levels on the product corresponding to the RFID tag is previously stored (Operation 623). If it is determined that the information on privacy levels on the product corresponding to the RFID tag is not previously stored, the privacy management server 540 takes a necessary action.

If information on the owner of the product is previously stored, the privacy management server 540 inquires about a privacy policy in real-time using a cellular phone or a PDA of the owner (Operation 624). If there is a response to the inquiry within a designated time period (Operation 625), the privacy management server 540 receives the privacy policy, i.e., the information on the privacy levels (Operation 626). If there is no response to the inquiry within a designated time period, the privacy management server 540 provides basic privacy levels based on a basic privacy policy according to a law or another suitable standard (Operation 627).

When it is determined that the information on privacy levels is previously stored in Operation 623 or is received from the owner in real-time, or the basic privacy levels are provided, a policy of privacy levels is determined, and information on the determined privacy level is transmitted to the information server 530 (Operation 628).

The information server 530 compares the previously stored information on privacy levels or the policy information on privacy levels received from the privacy management server 540 in real-time with information on privacy levels stored in the RFID tag (received from the user requesting the privacy information), or sums the two types of information, and determines a final privacy level (Operation 630). In this operation, a predetermined reference for a privacy information disclosure is determined.

The information server 530 stores the information on privacy levels received from the privacy management server 540 and reuses it later when required. If the privacy management server 540 receives additional information on privacy levels from the owner, it is informed of the information server 530. If the information server 530 receives an inquiry for the product, the information server 530 does not uses the previously stored information on the product but inquires of the privacy management server 540 and provides privacy information to the user.

The information server 530 confirms the level of the recognition information of the user requesting the information, combines information to be provided to the user, and provides the information to the user (Operation 640).

The present invention provides results as indicated below.

1. When a user owns a product to which a RFID tag is attached, a RFID personal privacy framework is provided so that the user designates the privacy level of the product as required, and manages access to the product based on the designated privacy level.

2. When an information server receives an information request, a data structure of information is provided so that the privacy level designated by the user is mapped to designate the disclosure of information.

3. In an ubiquitous environment, personal privacy levels are designated in a privacy management server using a terminal connected to a wireless or wired network, which is connected to a RFID system (a reader, middleware, an information server, a directory server, etc.)

4. An authorization authentication is processed and managed based on personal privacy in response to a user's request for various business and access applications.

5. When a privacy authorization is completely authenticated, a requested service is rejected or limited according to a result of the authentication.

6. When privacy is protected using a system for providing privacy, a specific group including the user can access privacy information so that a better service is provided to the user.

7. When an authorization level of the privacy information of the user is reduced or is not required, an inquiry can be made using a variety of communication methods such as a direct wireless messaging service and the privacy information can be provided with a user's permission.

The present invention can be applied to a framework and a protocol for personal privacy protection in a RFID process for managing a supply network in distribution, manufacturing, and logistics industries. Owing to an introduction of the RFID process to a distribution and logistics system, information stored in RFID tags can be used to automatically inform workers of specific vehicles carrying specific products. When the products are provided to stores, a management system recognizes the products to which RFID tags are attached and automatically examines the number and list of the products. When consumers purchase the products, the stores automatically detect an amount of stock by an amount of products purchased by consumers so that the stores can order products.

Also, RFID determines authenticity of products and allows users to confirm distribution processes, thereby increasing service quality.

However, when a user carries his/her own product with him/her, information on the product and the user can be misused by the presence of an illegal reader in a wireless environment, resulting in a serious privacy invasion. Therefore, the present invention provides a technical method of protecting a privacy invasion in order to settle a privacy problem caused by providing a RFID service.

The present invention limits authorization of information on personal privacy through a privacy management server or a privacy management module and authenticates a user, such that the user can safely and securely carry and use products from an illegal reader, and provides a processing unit for controlling a personal privacy level anywhere and at any time, such that the RFID service is securely provided.

The embodiments of the present invention can be written as computer programs and can be implemented in general-use digital computers that execute the programs using a computer readable recording medium. Also, the data structure used in the embodiments of the present invention described above can be recorded on a computer readable recording medium through a variety of ways.

Although the present invention has been described with respect to the Internet as an example of the communication network, it is obvious that the present invention can be applied to various fields including a public switched telephone network (PSTN).

It would be obvious to those of ordinary skill in the art that each of the above operations of the present invention may be embodied by hardware or software, using general program techniques.

Also, some of the above operations of the present invention may be embodied as computer readable code in a computer readable medium. The computer readable medium may be any recording apparatus capable of storing data that is read by a computer system, e.g., a read-only memory (ROM), a random access memory (RAM), a compact disc (CD)-ROM, a CD-rewritable (RW), a magnetic tape, a floppy disk, a hard disk drive (HDD), an optical data storage device, a magnetic-optical storage device, and so on. Also, the computer readable medium may be a carrier wave that transmits data via the Internet, for example. The computer readable medium can be distributed among computer systems that are interconnected through a network, and the present invention may be stored and implemented as a computer readable code in the distributed system.

The present invention can prevent illegal exposure of information on products and product owners so that a RFID tag can be safely attached to a product, thereby introducing the RFID tag, avoiding a privacy invasion, and forming a safe ubiquitous environment.

Since users have different approaches to privacy, users can directly designate privacy policies, thereby controlling authorization of every service. Information is transferred to a subscriber so that a privacy protection of the subscriber is assured, a service environment is connected in real-time, and a service satisfying a request of the subscriber is provided.

A research of a user's favor or a user's response of a product can be made without an invasion of user's privacy. Additional information can be provided with a user's permission, and a better service for privacy protection can be provided.

In particular, a variety of service levels for a product to which a RFID tag is attached are requested by a user and information on a service quality is transferred, thereby providing a more effective service, a service satisfying a subscriber's demand, and additional service using information on a service authentication level, which satisfies a user purchasing a product or a subscriber or a personal information user.

While the present invention has been particularly shown and described with reference to exemplary embodiments thereof, it will be understood by those of ordinary skill in the art that various changes in form and details may be made therein without departing from the spirit and scope of the present invention as defined by the following claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. An electronic tag attached to an object which transmits information stored therein through a predetermined frequency band of a signal, comprising privacy level number information, the electronic tag comprising:

a tag ID region containing recognition information distinguishing the electronic tag from other electronic tags; and a personal privacy level number region containing a personal information protection level by using a level number designating a personal privacy level number of privacy information, relating to the electronic tag's attached object, wherein the personal information protection level number is transmitted over the predetermined wireless frequency band and wired network which is able to transport the personal information protection level number securely to a privacy protection apparatus that determines how much privacy information to provide based on the personal privacy level number information determined by an owner of the object, wherein each time information is requested from the electronic tag attached to the object, the owner of the object is informed of the request.

2. The electronic tag of claim 1, further comprising: a tag memory storing personal privacy level number information by using the level number.

3. The electronic tag of claim 1, wherein the electronic tag comprises a RFID of the object, wherein the RFID includes the personal information protection level number by personal sensitivity (PIPL-PS) related to a tagged object for personal usage.

4. A privacy protection apparatus using an electronic tag, comprising:

an information storing unit storing personal privacy information related to the electronic tag;

an information request/response processing unit receiving identified recognition information of the electronic tag and information on a user that requests information on the electronic tag through a predetermined privacy protection apparatus system;

a privacy policy managing unit determining whether the personal privacy information on the electronic tag corresponding to the recognition information of the electronic tag is stored in the information storing unit; and an information disclosure determination processing unit, if it is determined that the personal privacy level information on the electronic tag is stored in the information storing unit, determining how much of the privacy information on the electronic tag to provide based on personal privacy level information designating a personal privacy level of the privacy information in the electronic tag, and providing the determined privacy protection apparatus system's personal privacy level information determined by the user's privacy sensitivity to the user, wherein an owner of the electronic tag is informed of the request, wherein the information request/response processing unit receives the recognition information of the electronic tag and information indicating that a new ownership of a product to which the electronic tag is attached is changed or determined by selling the product to which the electronic tag is attached in a store, and updates the personal privacy level information stored in the information storing unit, receives information, wherein the tag update the personal privacy level information from the privacy protection apparatus system, and a predetermined personal privacy preference, necessary for disclosing the privacy information from the changed or determined ownership, and updates the information.

* * * * *